United States Patent [19]

Miller

[11] 4,106,308

[45] Aug. 15, 1978

[54] HEATING AND COOLING SYSTEM WITH CAPILLARY CONTROL MEANS

[75] Inventor: Jerome Freed Miller, Auburn, N.Y.

[73] Assignee: The Singer Company, New York, N.Y.

[21] Appl. No.: 798,529

[22] Filed: May 19, 1977

[51] Int. Cl.[2] ..... F25B 13/00; F25B 39/02; F25B 41/06

[52] U.S. Cl. ..... 62/324; 62/504; 62/511

[58] Field of Search ..... 62/324, 504, 511

[56] References Cited

U.S. PATENT DOCUMENTS

| | | | |
|---|---|---|---|
| 2,746,266 | 5/1956 | Kosfeld | 62/324 |
| 2,956,421 | 10/1960 | Stevens | 62/511 |
| 3,006,162 | 10/1961 | Massa | 62/511 |
| 3,105,367 | 10/1963 | Osborn | 62/511 |
| 3,172,272 | 3/1965 | Alsing | 62/511 |
| 4,057,976 | 11/1977 | del Toro et al. | 62/324 |

FOREIGN PATENT DOCUMENTS

| | | | |
|---|---|---|---|
| 1,240,474 | 7/1960 | France | 62/324 |

*Primary Examiner*—Lloyd L. King
*Attorney, Agent, or Firm*—William V. Ebs; Edward L. Bell; Robert E. Smith

[57] ABSTRACT

An air conditioning system which is operable on either a heating or cooling cycle is provided with capillary control means including a plurality of branch lines between heat exchangers of the system, and one or more of the branch lines of the capillary system is located in a heat exchanging relationship with a refrigerant line portion adjacent one of the heat exchangers to cause the flow of refrigerant in the system to be retarded when such heat exchanger is caused to function as a condenser.

1 Claim, 1 Drawing Figure

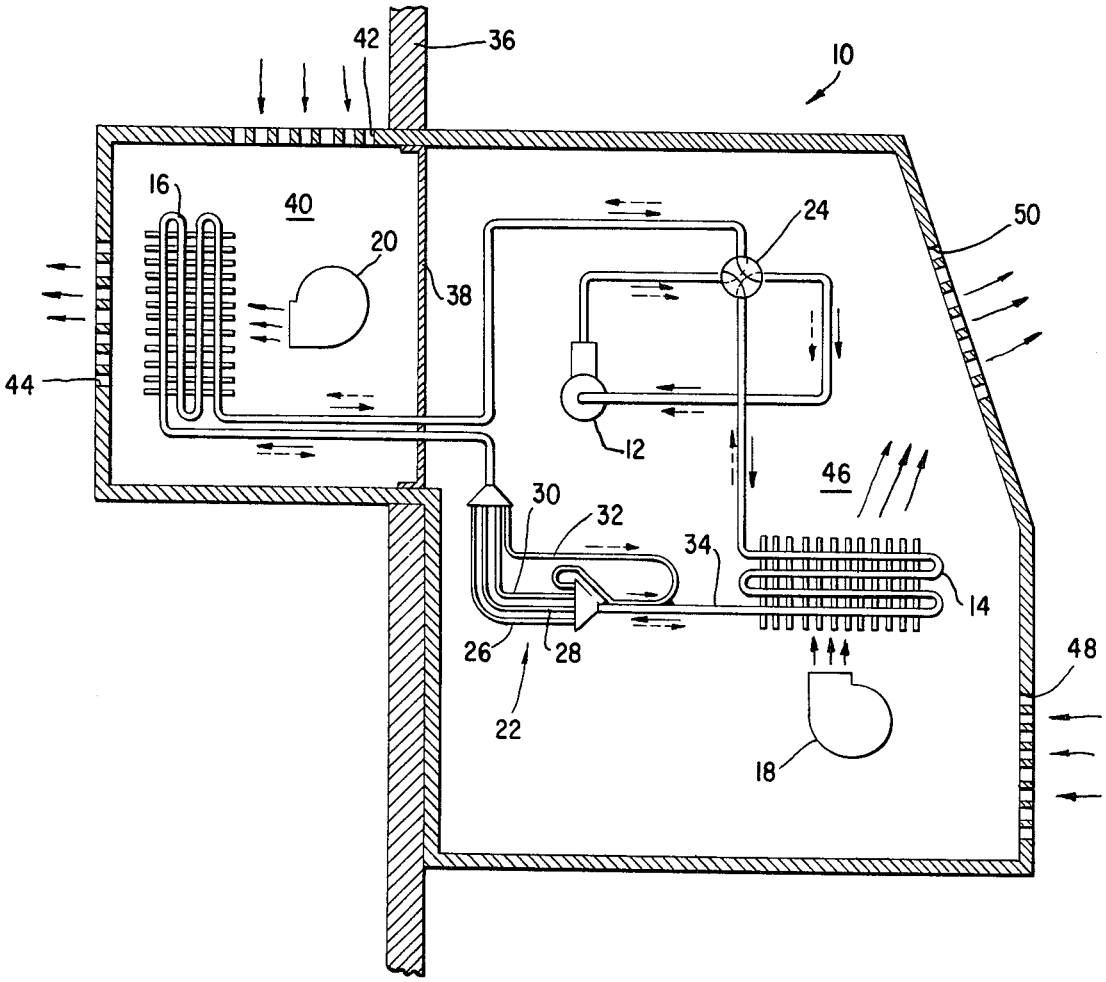

HEATING AND COOLING SYSTEM WITH CAPILLARY CONTROL MEANS

BACKGROUND OF THE INVENTION

1. Field of the Invention

The invention relates to air conditioning equipment which can be operated on either a heating or cooling cycle.

2. Description of the Prior Art

Difficulties have been encountered in maintaining the temperature within a room substantially constant with air conditioning equipment. With any heating and/or cooling air conditioning system responsive to wall mounted thermostats, the inherent characteristics of thermostat differential and response time have provided wide fluctuations in room temperature or required expensive apparatus to reduce the temperature variations. An attempt has been made to reduce the fluctuations in room temperature by locating the control thermostat for the air conditioner within the unit rather than at a remote location in the room. This has been done, for example, in reverse cycle heating and cooling units utilizing a circulating refrigerant and having an electric heater for use when temperature falls below a predetermined level. However, such an arrangement requires the constant operation of a fan within the unit to limit temperature fluctuations, and air discharged when the heater is deenergized, even if at the ambient level, feels excessively cool because of its velocity.

A primary object of this invention is to provide a superior air conditioning unit which is particularly suited to maintaining room temperatures within narrow limits in response to the operation of a wall thermostat, is simple in design and affords the designer greater flexibility in the selection of heat exchangers than was heretofore possible.

SUMMARY OF THE INVENTION

In accordance with the invention a reversible heating and cooling air conditioning unit utilizing a circulating refrigerant is provided with a capillary system including a plurality of branch lines between inside and outside heat exchangers, and one or more such branch lines is disposed in a heat exchanging relationship with a refrigerant carrying line portion adjacent one of the heat exchangers. One heat exchanger functions as a condenser whereas the other functions as an evaporator during one mode of operation of the air conditioning unit, and their functions are reversed during the other mode of operation of the unit. Liquid refrigerant in said one or more branch lines is heated by the refrigerant carrying line portion with which it is in heat exchanging relation when the adjacent heat exchanger functions as a condenser, and is caused to flash to a gas at a point in said one or more branch lines such as to restrict the flow therein to negligible amount. The flow of refrigerant through the entire system is thereby retarded. When such heat exchanger functions as an evaporator, the refrigerant carrying line portion associated with said one or more branch lines is cold; liquid flows through all of the capillary branch lines to their normal balance points and the capillary system performs a normal metering function.

The capillary arrangement of the invention enables a designer to use off-the-shelf heat exchangers selected from units of various ratings, and yet provide for rates of flow of refrigerant assuring gradual increases and decreases in the temperature of conditioned air, whereas without such capillary arrangement he is limited in his choice of heat exchangers, and, even with the most carefully selected units cannot satisfactorily control room temperatures within narrow limits in response to the operation of a wall thermostat.

DESCRIPTION OF THE DRAWINGS

The drawing is a diagrammatic illustration showing a reversible air conditioning system incorporating the invention.

DESCRIPTION OF THE PREFERRED EMBODIMENT

Figure 1:
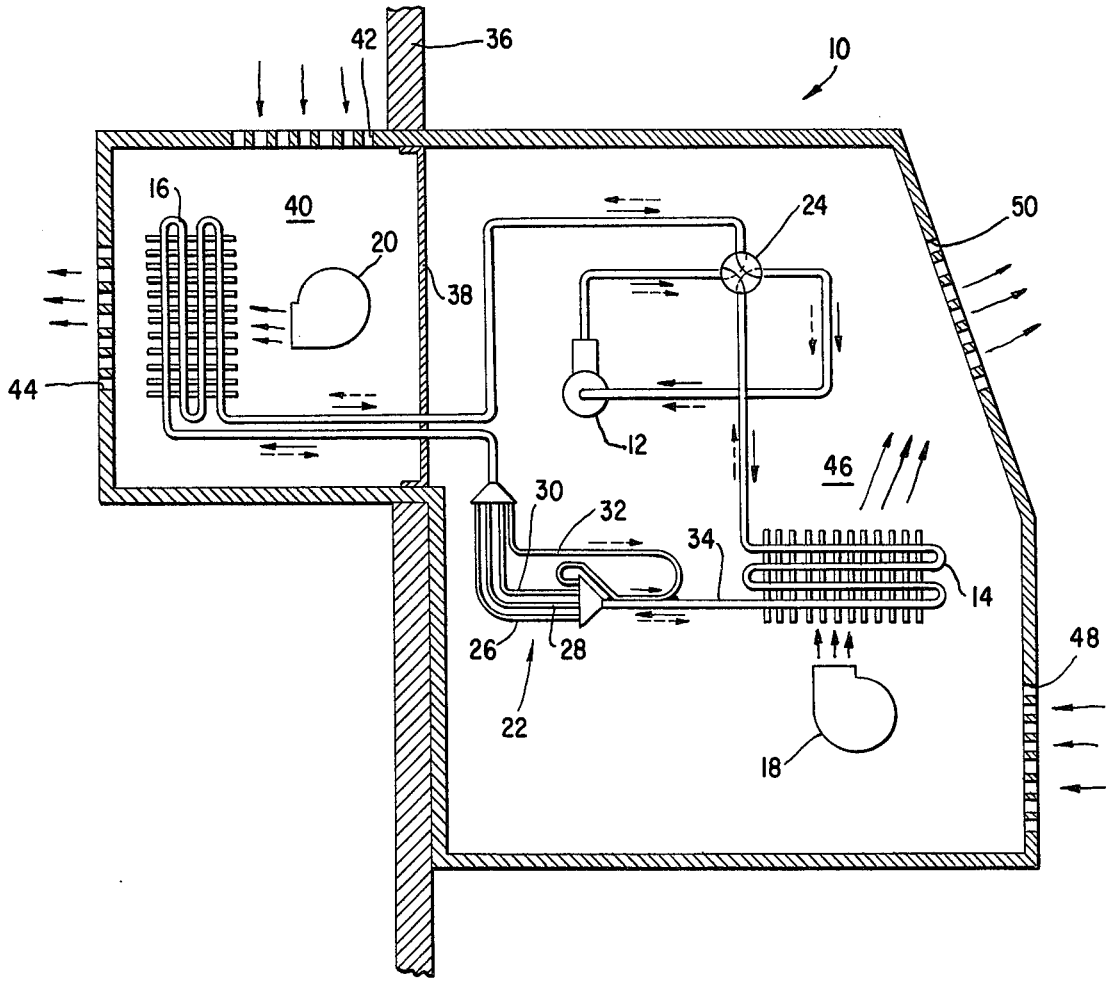

Referring to the drawing reference character 10 designates an air conditioning unit including a compressor 12, a roomside heat exchanger 14, another heat exchanger 16 communicating with the outside air, blowers 18 and 20 associated with heat exchangers 14 and 16 respectively, a capillary system 22 in a refrigerant carrying line between the two heat exchangers, and a reversing valve 24 operable to reverse the direction of the flow of refrigerant through the heat exchangers. In accordance with the invention the capillary system 22 is formed with a plurality of small diameter branch lines such as indicated by reference characters 26, 28, 30 and 32, and at least one such branch line (32 as shown) is looped and disposed in heat exchanging relationship with a portion 34 of refrigerant piping connecting the capillary system to the roomside heat exchanger. The heat exchanging relationship is established by contact, as by fastening branch line 32 to piping portion 34 with solder, clamps or the like.

As shown, the air conditioning unit 10 is mounted in the outside wall 36 of a room. The unit is partitioned at 38 and includes the heat exchanger 16 and blower 20 in partitioned space 40 communicating with outside air through inlet and outlet openings 42 and 44 respectively. The roomside heat exchanger 14 and blower 18 are located in partitioned space 46 communicating with the room through inlet opening 48 and outlet opening 50.

Reversing valve 24 is a thermostatically controllable valve of a type commonly used in reversible air conditioning systems. When heat is called for, the valve is positioned to cause refrigerant pumped by the compressor to flow in the direction indicated by the solid arrows on the drawing, that is, first through heat exchanger 14, next through the capillary system 22, then through the heat exchanger 16 and finally back through the valve to the compressor. When a reduction in temperature is called for, valve 24 is positioned to cause refrigerant pumped by the compressor to flow in the direction indicated by the broken arrows, that is, first through the heat exchanger 16 and then sequentially through capillary system 22, heat exchanger 14 and reversing valve 24 to the compressor 12.

During the heating cycle the roomside heat exchanger 14 functions as a condenser. Air drawn from the room to be heated through opening 48 is blown across coils of the roomside heat exchanger and into the room through vent 50. The roomside heat exchanger gives up heat to the air moved through it and the temperature in the room is increased. The other heat exchanger functions as an evaporator during the heating cycle and absorbs heat from outside air forced through it by blower 20.

During the cooling cycle, heat exchanger 16 functions as a condenser and gives up heat to outside air propelled through its coils by blower 20. The roomside heat exchanger 14 functions as an evaporator and absorbs heat from room air moved through it by blower 18 to cool the room.

The capillary system 22 performs a normal metering function for refrigerant during the cooling cycle with its branch lines 26, 28, 30 and 32 providing for the flow of refrigerant at a rate depending upon their inside diameter and length. During the heating cycle flow is restricted in branch line 32 as determined by the heat exchanging relationship between such branch line and refrigerant line portion 34 adjacent heat exchanger 14. Flow through the system is therefore retarded accordingly.

Alteration of the structure herein disclosed will suggest themselves to those skilled in the art and it is to be understood that the present disclosure relates to an embodiment of the invention which is for purposes of illustration only. It is not to be construed as a limitation of the invention. All modification which do not depart from the spirit of the invention are intended to be included within the scope of the claims.

Having thus disclosed the nature of this invention, what is claimed herein is:

1. In a reversible air conditioning system, means for compressing a refrigerant to be circulated through the system, a roomside heat exchanger, another heat exchanger exposed to outside air, a capillary system for metering the flow of refrigerant between the two heat exchangers, and a reversing valve for reversing the direction of flow of refrigerant through the two heat exchangers and capillary system, the capillary system including a plurality of branch lines all of which are out of heat exchanging relationship with both of said heat exchangers, and at least one of the said branch lines including a looped portion in a heat exchanging contacting relationship with a refrigerant carrying line between the capillary system and the roomside heat exchanger.

* * * * *